US011098512B2

(12) United States Patent
Blum et al.

(10) Patent No.: US 11,098,512 B2
(45) Date of Patent: Aug. 24, 2021

(54) GUIDE SYSTEM FOR GUIDING A FURNITURE DOOR

(71) Applicant: Julius Blum GmbH, Hoechst (AT)

(72) Inventors: Lukas Blum, Bregenz (AT); Ingo Gasser, Hoechst (AT); Matthias Rupp, Hohenweiler (AT)

(73) Assignee: JULIUS BLUM GMBH, Hoechst (AT)

( * ) Notice: Subject to any disclaimer, the term of this patent is extended or adjusted under 35 U.S.C. 154(b) by 47 days.

(21) Appl. No.: 16/656,086

(22) Filed: Oct. 17, 2019

(65) Prior Publication Data

US 2020/0048946 A1 Feb. 13, 2020

Related U.S. Application Data

(63) Continuation of application No. PCT/AT2018/000040, filed on May 4, 2018.

(30) Foreign Application Priority Data

May 11, 2017 (AT) ..... A 50394/2017

(51) Int. Cl.
*E05D 15/16* (2006.01)
*E05D 15/06* (2006.01)
(Continued)

(52) U.S. Cl.
CPC ..... *E05D 15/0652* (2013.01); *A47B 61/00* (2013.01); *A47B 77/08* (2013.01);
(Continued)

(58) Field of Classification Search
CPC ..... E05D 15/0621; E05D 15/0604; E05D 15/0608; E05D 15/10; E05D 15/1042;
(Continued)

(56) References Cited

U.S. PATENT DOCUMENTS 837,819 A * 12/1906 Ferris ..... E05F 5/003 16/94 R
1,380,668 A 6/1921 Martin
(Continued)

FOREIGN PATENT DOCUMENTS

CN 103850554 6/2014
CN 104145123 11/2014
(Continued)

OTHER PUBLICATIONS

Office Action dated Nov. 30, 2020 in corresponding Japanese Patent Application No. 2019-561806, with English Translation.
(Continued)

*Primary Examiner* — Chuck Y Mah
(74) *Attorney, Agent, or Firm* — Wenderoth, Lind & Ponack, L.L.P.

(57) ABSTRACT

A guide system for guiding a furniture door, in particular a folding door or folding-sliding door, relative to a fixed furniture part includes a first guide rail and a running carriage which can be connected to the furniture door and which has a rolling body via which the running carriage is movably mounted on the first guide rail. The first guide rail has a running surface for the rolling body of the running carriage, and the first guide rail is assembled in the longitudinal direction from a first rail piece and one second rail piece. The two rail pieces can be releasably connected via a connecting piece on which there is formed a portion of the running surface for the rolling body of the running carriage.

20 Claims, 8 Drawing Sheets

(51) Int. Cl.
*A47B 61/00* (2006.01)
*A47B 77/08* (2006.01)
*E05D 15/26* (2006.01)

(52) U.S. Cl.
CPC ..... *E05D 15/26* (2013.01); *E05D 15/266* (2013.01); *E05Y 2201/684* (2013.01); *E05Y 2900/212* (2013.01)

(58) Field of Classification Search
CPC ..... E05D 15/26; E05D 15/266; E05D 2015/1005; E05F 1/16; E05F 3/06; E05F 3/18; E05F 5/003; E05Y 2201/212; E05Y 2201/412; E05Y 2201/684; E05Y 2600/314; E05Y 2900/20; E05Y 2900/212; E06B 3/4762
See application file for complete search history.

(56) References Cited

U.S. PATENT DOCUMENTS 3,155,149 A * 11/1964 Ford ..... A47H 15/02 160/346
3,990,183 A * 11/1976 Meggs ..... A47K 3/362 49/125
4,905,345 A * 3/1990 Lunenschloss ..... E05D 15/06 16/94 R
5,355,805 A 10/1994 Haab et al.
6,719,158 B2 * 4/2004 Goldberg ..... A47G 25/0692 211/105.1
6,892,783 B1 * 5/2005 Comeau ..... A47H 1/08 160/126
9,284,761 B2 3/2016 Haab et al.
9,297,192 B2 * 3/2016 Choi ..... B60J 5/06
9,624,705 B2 4/2017 Haab et al.
2002/0170234 A1 * 11/2002 Salice ..... E05D 15/063 49/453
2007/0033874 A1 * 2/2007 Jacobs ..... E05D 15/0652 49/130
2010/0031577 A1 * 2/2010 Haab ..... E05F 5/003 49/449
2014/0150208 A1 6/2014 Haab et al.
2016/0024826 A1 * 1/2016 Smith ..... E05D 15/0604 160/197
2016/0201368 A1 7/2016 Haab et al.
2016/0312521 A1 * 10/2016 Berger ..... E05D 15/00

FOREIGN PATENT DOCUMENTS

DE 75 28 036 1/1976
DE 7528036 1/1976
DE 10 2014 103 043 9/2015
EP 0 572 936 12/1993
EP 1 013 865 6/2000
EP 1705327 A2 * 9/2006 ..... E05D 15/0652
EP 2 584 131 4/2013
EP 2578785 A2 * 4/2013 ..... E05D 15/0652
FR 2347517 A1 * 11/1977 ..... E05D 15/0621
GB 830248 3/1960
GB 1046950 A * 10/1966 ..... E05D 15/0652
JP 2-143480 12/1990
JP 2009-299305 12/2009
JP 2014-114690 6/2014

OTHER PUBLICATIONS

International Search Report dated Aug. 6, 2019 in International (PCT) Application No. PCT/AT2018/000040.

* cited by examiner

GUIDE SYSTEM FOR GUIDING A FURNITURE DOOR

BACKGROUND OF THE INVENTION

The present invention concerns a guide system for guiding a furniture door, in particular a folding door or a folding-sliding door, relative to a stationary furniture part, and an article of furniture having at least one such guide system.

Guide systems for guiding a furniture door relative to a stationary furniture part are already known, wherein those guide systems in dependence on the respective dimensions of the article of furniture and the furniture doors to be guided have a guide rail of corresponding length.

That means, however, that transport is made more difficult as if many different guide rails have to be transported for different articles of furniture and furniture doors. In addition the assembly procedure is also made difficult as the person carrying out the assembly operation has to fit possibly very long guide rails to the article of furniture. In addition such guide systems are highly inflexible as it is necessary to provide respective guide rails that correspond to the respective dimensions of the articles of furniture and the furniture doors.

Considering that system, the guide rail of the guide system could also be cut into pieces. When the pieces of the guide rail are re-assembled then when the carriage runs along the assembled guide rail, it causes audible noise, this additionally resulting in bumpy unsettled rolling movement of the carriage.

SUMMARY OF THE INVENTION

The object of the invention is to avoid at least one of the above-described disadvantages and to provide a guide system which is improved over the state of the art and an improved article of furniture.

An essential idea in regard to the guide system according to the invention is therefore that the at least one first guide rail is composed in the longitudinal direction of at least a first rail portion and a second rail portion, wherein the two rail portions can be releasably connected by way of at least one connecting portion at which there is provided a portion of the at least one running surface for the at least one rolling body of the at least one running carriage. That ensures a smoother travel of the carriage along the at least one running surface.

So that the connection between the individual rail portions is improved and audible noise can be substantially avoided it can be provided that the rail portions of the at least one first guide rail can be positioned relative to each other with the at least one connecting portion by way of at least one respective positioning device, preferably wherein the at least one positioning device has at least one wedge and at least one corresponding counterpart shape.

By virtue of the at least one positioning device it is possible for the transition between the rail portions to be substantially stepless and only tolerances of the material play a part. The connection itself does not involve any additional differences in level between the rail portions.

As mentioned in the opening part of this specification protection is also claimed for an article of furniture having at least one furniture door, in particular a folding door or folding-sliding door, at least one stationary furniture part and at least one guide system for guiding the at least one furniture door relative to the at least one stationary furniture part.

BRIEF DESCRIPTION OF THE DRAWINGS

Further advantages and details of the invention will be apparent from the Figures and the accompanying specific description. In the Figures.

DETAILED DESCRIPTION OF THE INVENTION

Figure 1A:
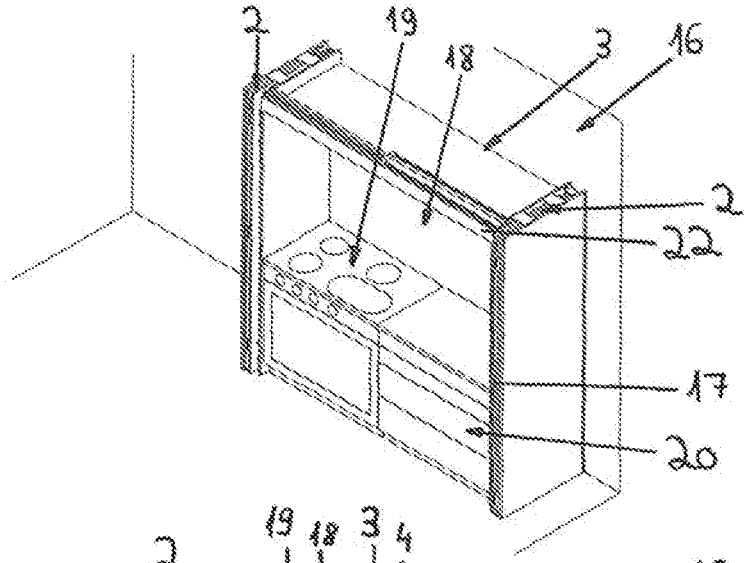
FIGS. 1*a*-1*c* show perspective views of an article of furniture with two furniture doors shown in different positions.
Figure 1B:
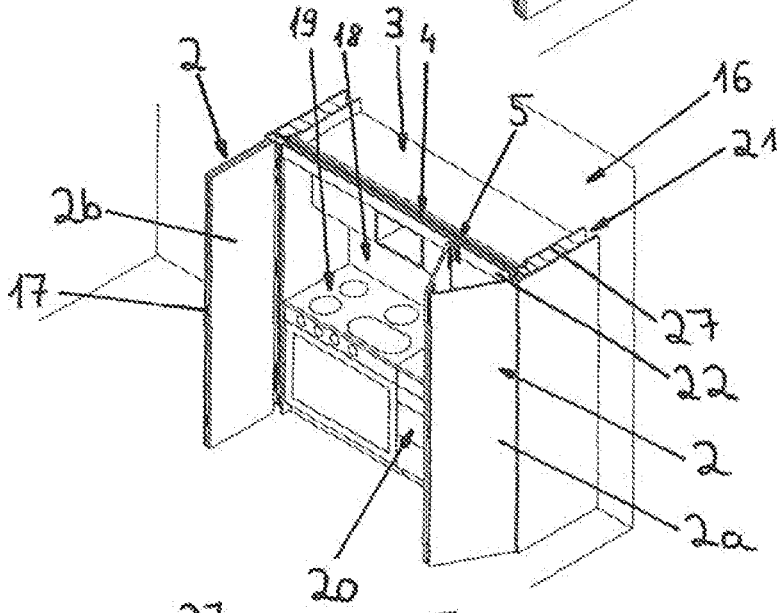
Figure 1C:
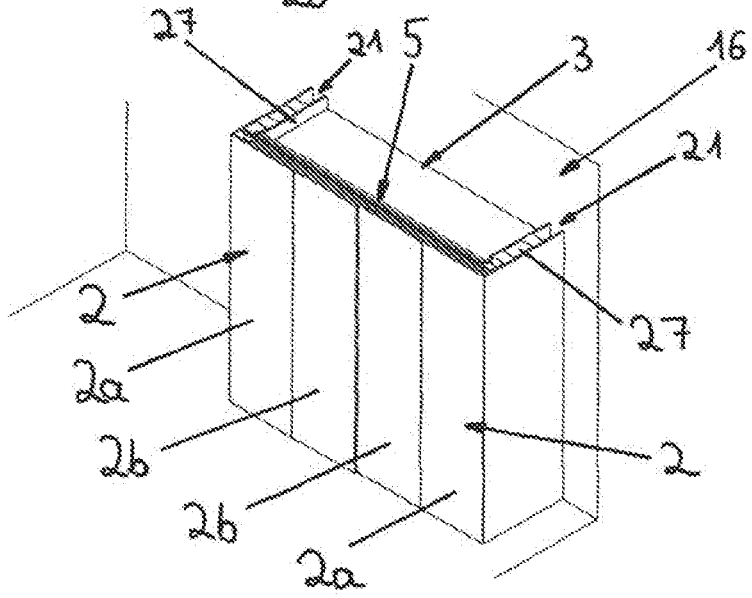

FIGS. 1*a*, 1*b* and 1*c* show an article of furniture 16 having a stationary furniture part 2, two furniture walls 27 and two furniture doors 2. Those furniture doors 2 are in the form of folding-sliding doors and each comprise a first door leaf 2*a* and a second door leaf 2*b*, wherein the two door leaves 2*a*, 2*b* are foldable by way of the folding door hinges 17. The article of furniture 16 further has a receiving region 18 and two laterally arranged receiving compartments 21 or "pockets". It is therefore provided that the article of furniture 16 has a receiving region 18 for receiving components of a kitchen 19 (for example electric appliances like cooker, oven and so forth), a clothes storage arrangement 20 (for example drawers, coat hangers, boxes etc) or the like.

A respective furniture door 2 is retractable in the two receiving pockets 21 which can be arranged laterally in or on the article of furniture 16. The receiving pockets 21 can therefore be arranged either from the exterior on the article of furniture 16 or however the receiving pockets 21 are in the article of furniture 16, for example by the arrangement of an additional wall.

In that respect the view shown in FIG. 1*a* corresponds to the parked position of the furniture doors 2 and that shown in FIG. 1*c* corresponds to the closed position of the furniture doors 2. The second door leaf 2*b* is respectively coupled to a running carriage 5, the carriage 5 being displaceable along a first guide rail 4. Arranged in the receiving pockets 21 or more precisely at the furniture walls 27 are further guide rails 14 (not visible) for guiding the furniture doors 2. In that arrangement the two receiving pockets 21 are of an internal width of 10 to 30 cm and/or a height of 100 to 250 cm and/or a depth of 60 to 100 cm. The first guide rail 4 is therefore arranged substantially transversely relative to the further guide rails 14 on the article of furniture 16.

In addition there is provided a bar 22 which is either part of the first guide rail 4 or is in the form of a component separate therefrom. The movement of the furniture doors 2 between the parked position and the closed position is therefore made possible by the first guide rail 4 and the further guide rails 14. Starting from the parked position of the furniture doors 2, in which the door leaves 2*a*, 2*b* are oriented substantially parallel to each other, the furniture doors 2 can therefore be moved into that position in FIG. 1*b*, which is visible by virtue of the furniture door 2 shown at the left. In that case the furniture doors 2 are displaced along the further guide rails 14. Subsequently the furniture doors 2 are moved into the substantially coplanar position as shown in FIG. 1*c*. For that purpose the respective door leaf 2*b* is displaced by means of the carriage 5 along the first guide rail 4 until reaching the closed position of the furniture doors 2, in which the two door leaves 2*a*, 2*b* are oriented in substantially coplanar relationship. For moving the furniture doors 2 from their closed position into their parked position the same procedure is carried out in the reverse sequence.

Figure 2:
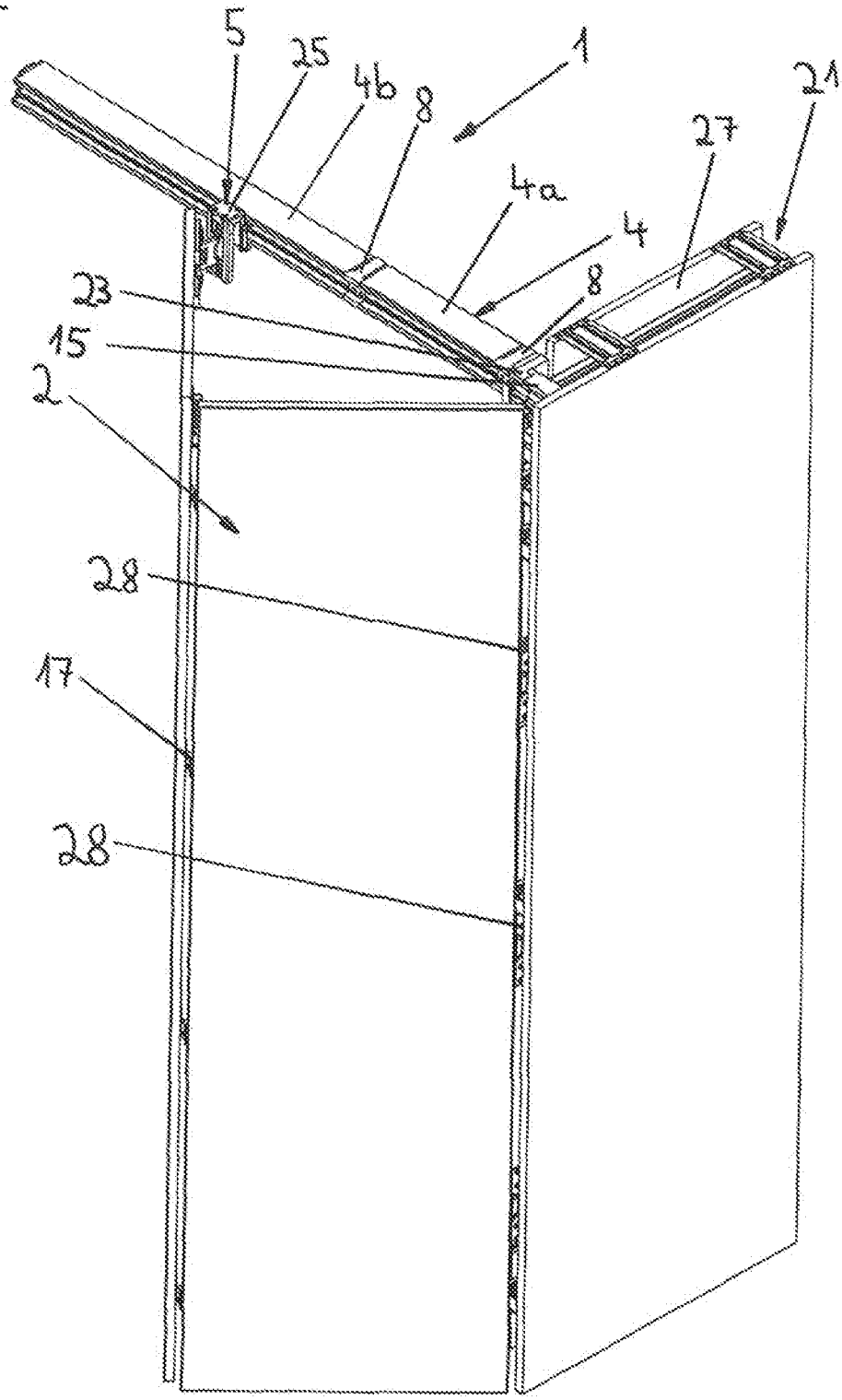
FIG. 2 shows a guide system and a folding-sliding door as a perspective view.

FIG. 2 shows the guide system 1 which includes the first guide rail 4 and the carriage 5. In this case the first guide rail 4 comprises the two rail portions 4*a*, 4*b*, those two rail portions 4*a*, 4*b* being connected together by way of the connecting portion 8. In addition there is provided a transfer device 23 connected to the first rail portion 4*a* of the first guide rail 4 by way of the connecting portion 8. At its underside the transfer device 23 has a control cam so that the kinetic energy of the furniture door 2 can be utilised in the transition from the first guide rail 4 on to the further guide rail 14 or from the further guide rail 14 on to the first guide rail 4. In the illustrated view the carrier 15 adjoins that transfer device 23. In addition a respective vertical carrier structure 34 is mounted moveably at the further guide rails 14, wherein hinges 28 are arranged on that carrier structure 34 for fixing the first door leaf 2*a* of the furniture door 2 so that the furniture door 2 can be retracted into the receiving pockets 21. When the furniture door 2 is moved into that position in which the door leaves 2*a*, 2*b* are oriented in substantially mutually parallel relationship then the carriage 5 is displaced on to the carrier 15. The carrier 15 is further arranged on the vertical carrier structure 34 and thus the furniture door 2 can be displaced along the further guide rail 14. There are therefore provided at least one further guide rail 14 and at least one carrier 15, wherein the at least one carrier 15 is mounted displaceably at the at least one further guide rail 14, the at least one carriage 5 can be arranged on or at the at least one carrier 15 and the at least one carrier 15 can be arranged at least region-wise in the prolongation in relation to the first guide rail 4.

Figure 3A:
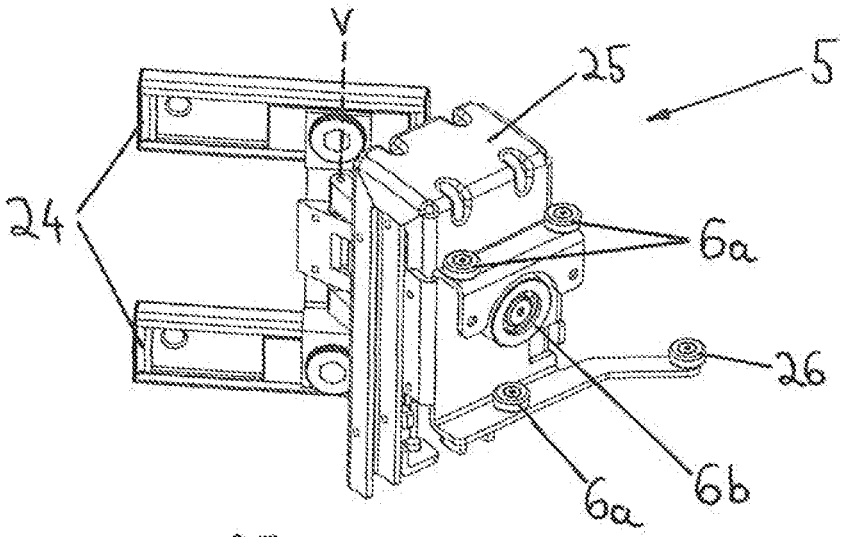
FIGS. 3*a*-3*b* show the carriage as a perspective view, a plan view and a detail of the plan view.
Figure 3B:
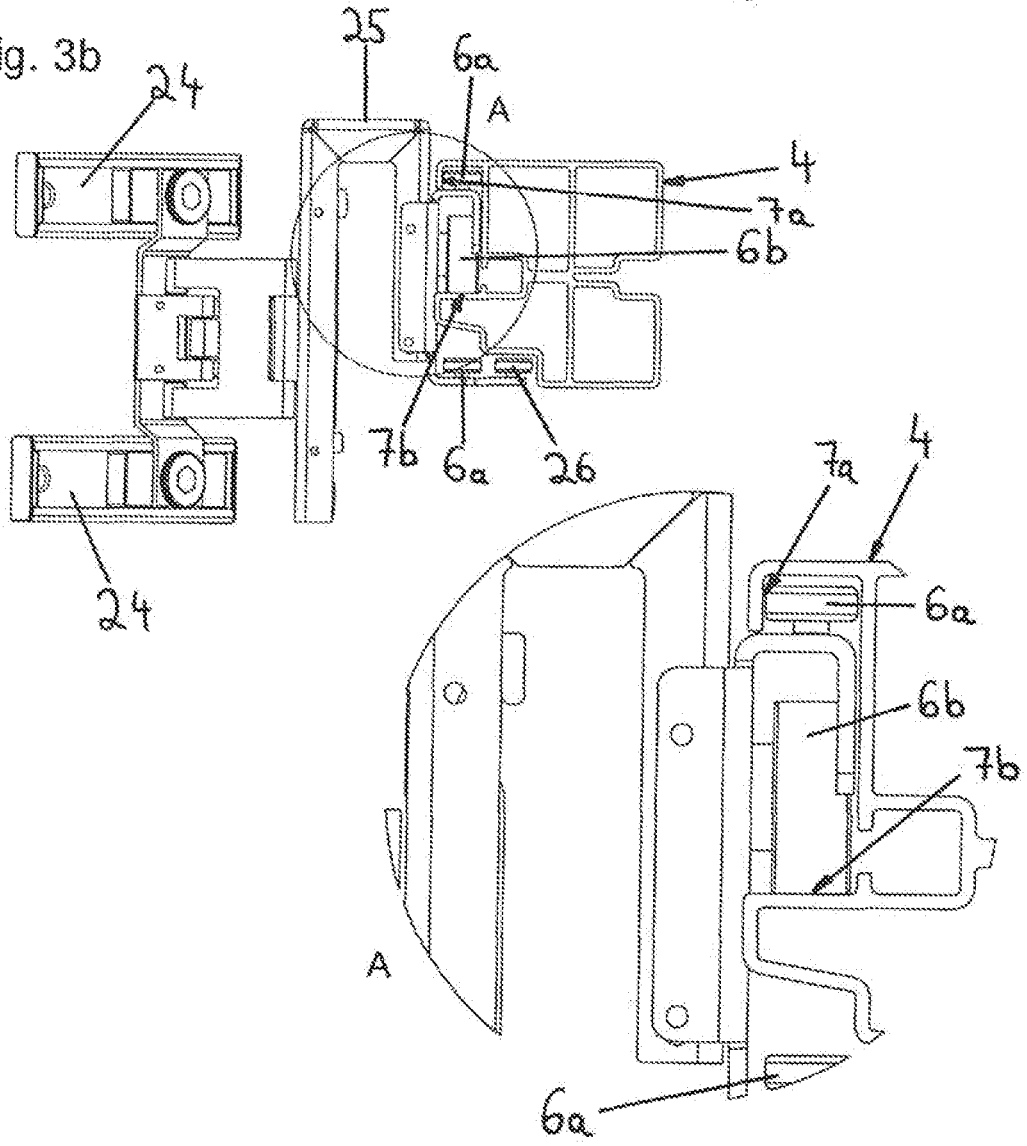

FIG. 3*a* shows a perspective view of the carriage 5. The carriage 5 has a carrier profile member 25 and the fitments 24 hingedly connected to the carrier profile member 25 about the vertical axis V. Those fitments 24 serve for fixing the door leaves 2*b*. In addition the rolling bodies 6*a* and 6*b* and the control roller 26 are arranged on the carrier profile member 25. In that case the rolling bodies 6*a* and the control roller 26 are mounted rotatably about a vertical axis and the rolling body 6*b* is mounted rotatably about a horizontal axis (that rotatable mounting configuration relates to the assembled position of the carriage 5). FIG. 3*b* shows the carriage 5 mounted moveably along the first guide rail 4 as a plan view and a detail view of the region A. It can be seen in that respect that the carrier profile member 25 is of a substantially U-shaped configuration so that the carrier profile member 25 can be fitted on to the bar 22 and is also displaceable along the bar 22. The first guide rail 4 has the two running surfaces 7*a*, 7*b*, wherein the two upper rolling bodies 6*a* are supported at the running surface 7*a* and are displaceable along same. In contrast the rolling body 6*b* is supported at the running surface 7*b* and is displaceable along same. Accordingly the rolling bodies 6*a* serve to carry horizontal forces and the rolling body 6*b* serves to carry vertical forces (for example the force due to the weight of the furniture door 2 which can be arranged on the carriage 5 by way of the fitments 24).

Figure 4:
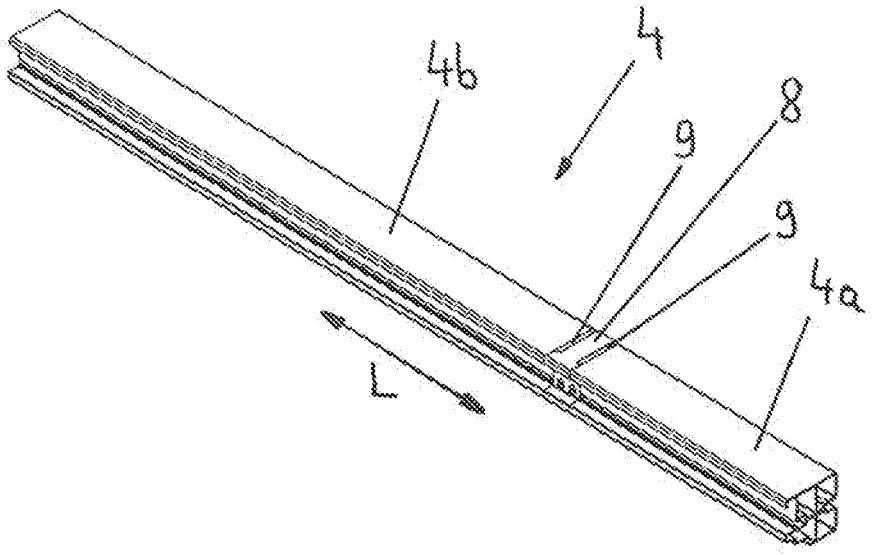
FIG. 4 shows a perspective view of a first embodiment of the first guide rail which has been cut into pieces.

FIG. 4 shows a first embodiment of the first guide rail 4 which has been cut into pieces in the longitudinal direction L. That first guide rail 4 has the first rail portion 4*a* and the second rail portion 4*b*. In this view the two rail portions 4*a*, 4*b* are already connected together. In that respect it can be provided that at least one of the rail portions 4*a*, 4*b* of the at least one first guide rail 4 can be adapted in respect of its length, with connectability to further rail portions 4*a*, 4*b* being retained.

Figure 5:
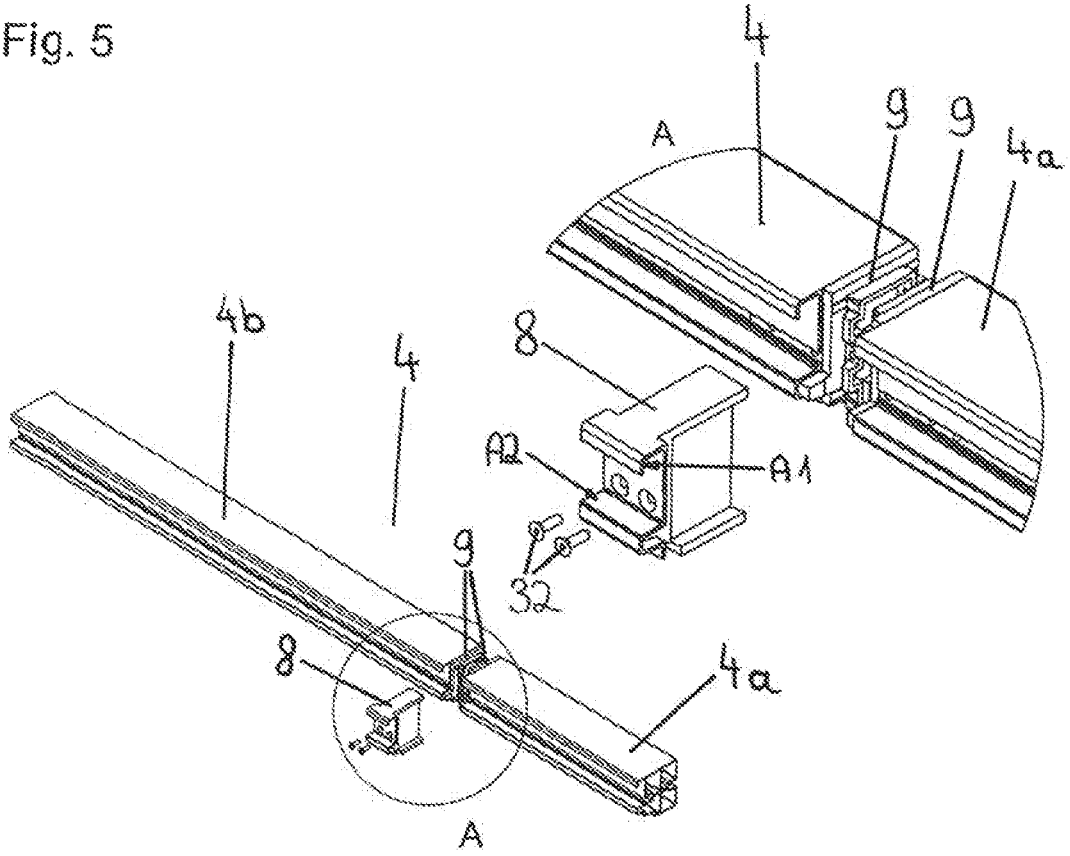
FIG. 5 shows a perspective view of the first guide rail which has been cut into pieces.

FIG. 5 shows the first guide rail 4 comprising the two rail portions 4*a*, 4*b*. in a perspective view and a detail view of the region A. Here it is possible to see the two adaptor portions 9 which are fitted into the two rail portions 4*a*, 4*b*. The rail portions 4*a*, 4*b* of the at least one first guide rail 4 are in this case in the form of a hollow chamber profile member, preferably wherein possibly provided adaptor portions 9 can be at least region-wise received in end parts of the rail portions 4*a*, 4*b*. The connecting portion 8 can be inserted between those two adaptor portions 9 and then the two screws 32 are screwed into the respective holes in the connecting portion 8 and the adaptor portions 9 so that the connecting portion 8 is screwed to the two adaptor portions 9 and at the same time a connection is made between the two rail portions 4*a*, 4*b*. It is therefore provided that the rail portions 4*a*, 4*b* of the at least one first guide rail 4 respectively have at least one adaptor portion 9, by way of which the rail portions 4*a*, 4*b* can be releasably connected to the at least one connecting portion 8, preferably by way of a screw and/or clamping connection.

It is noted at this juncture that the adaptor portions 9 can also be in one piece with the respective rail portion 4*a*, 4*b*. In this connection it is also noted that the respective at least one adaptor portion 9 in the assembled state (see FIG. 4) is substantially concealed relative to the exterior by the respective rail portion 4*a*, 4*b* and the at least one connecting portion 8. In addition provided on the connecting portion 8 is the portion A1 of the running surface 7*a* for the rolling bodies 6*a* of the carriage 5 and the portion A2 of the running surface 7*b* for the rolling body 6*b* of the carriage 5.

Figure 6:
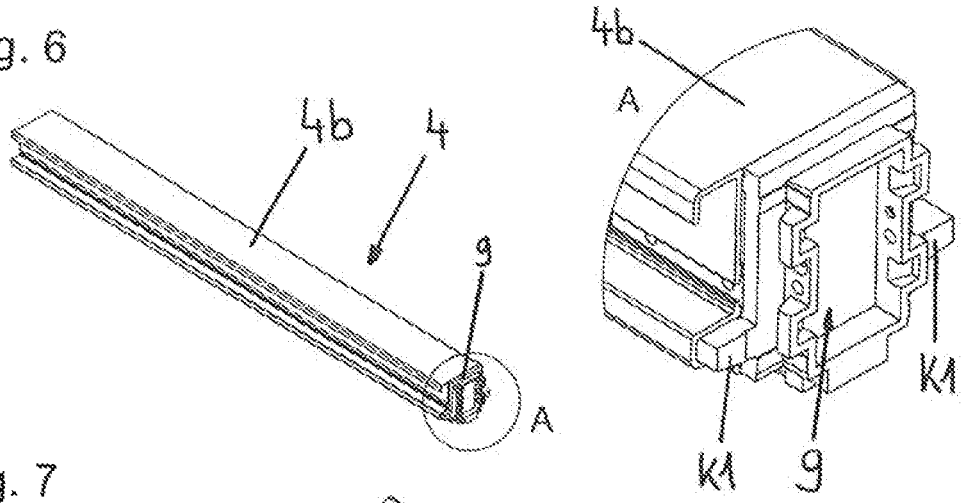
FIG. 6 shows a perspective view and a detail thereof illustrating a rail portion of the first guide rail.

FIG. 6 shows a perspective view and a detail view of the region A illustrating the second rail portion 4*b* and the adaptor portion 9 received in the second rail portion 4*b*. In this case it is possible to see the two wedges K1 of the adaptor portion 9.

Figure 7:
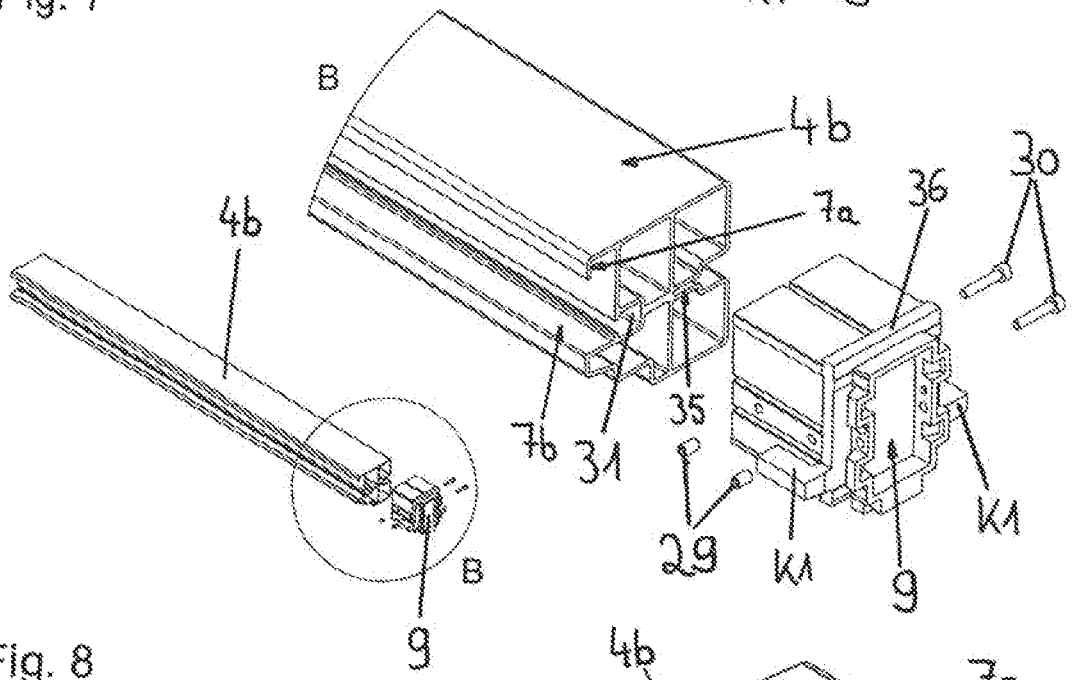
FIG. 7 shows a perspective view and a detail thereof illustrating a rail portion of the first guide rail and the adaptor portion.

FIG. 7 shows a perspective view and a detail view of the region B illustrating the second rail portion 4*b* and the adaptor portion 9. This view serves to explain the connection between the second rail portion 4*b* and the adaptor portion 9. At both sides at which the wedges K1 are provided the adaptor portion 9 respectively comprises two holes for receiving screws. After the adaptor portion 9 has been fitted into the rail portion 4*b* the grub screws 29 which have a male thread and the self-tapping screws 30 can be screwed into the respective holes. It is therefore provided that the adaptor portion 9 can be releasably connected to the respective rail portion 4*a*, 4*b*, preferably by way of a screw and/or clamping connection. Alternatively it would also be possible for the adaptor portions 9 to be glued into the respective rail portions 4*a*, 4*b*. When the grub screws 29 are sufficiently deeply screwed in, they meet the surface 31 so that when the grub screws 29 are further screwed in the adaptor portion 9 is moved in the direction of the running surfaces 7*a*, 7*b*. A similar consideration applies to the self-tapping screws 30 as the self-tapping screws 30 on being screwed in are screwed into the elongate slot 35 in the rail portion 4*b* and thus push the adaptor portion 9 in the direction of the running surfaces 7*a*, 7*b*. It can therefore be provided that the respective at least one adaptor portion 9 upon releasable connection to the respective rail portion 4*a*, 4*b* is moveable in the direction of the at least one running surface 7*a*, 7*b* for the at least one rolling body 6*a*, 6*b* of the at least one carriage 5. It will be appreciated that the nature of the screws referred to in this respect should not be interpreted as being restrictive. Other types of screws can also be used.

Figure 8:
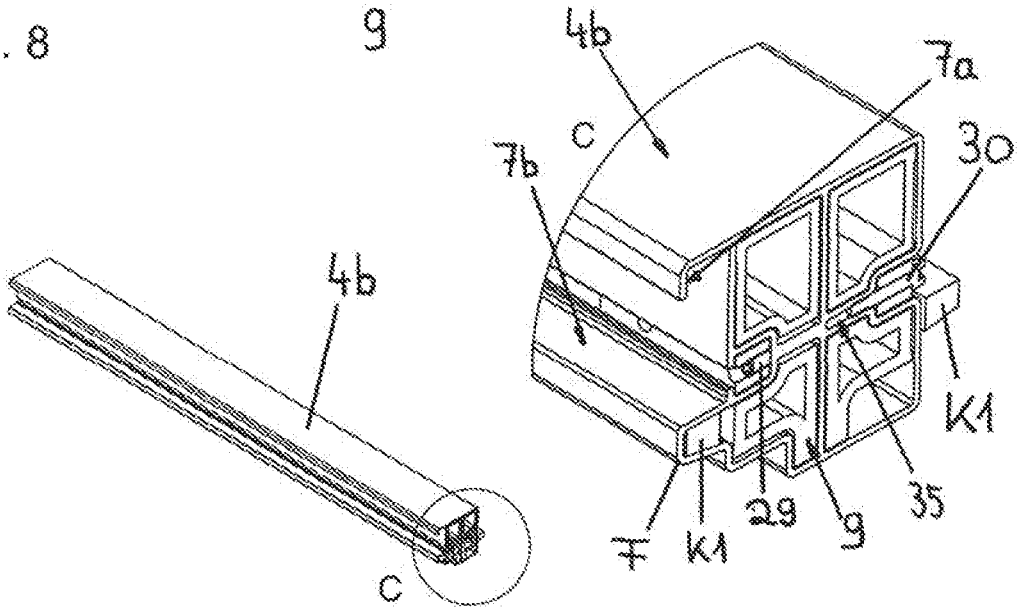
FIG. 8 shows a perspective sectional view and a detail thereof showing the rail portion of the first guide rail.

FIG. 8 shows the adaptor portion 9 received in the second rail portion 4*b* in a sectional view through the first screw plane and a detail view of the region C. The adaptor portion 9 has been moved in the direction of the running surfaces 7*a*, 7*b* by the screwed-in grub screws 29 and self-tapping screws 30, in which case the wedge K1 shown at the left has also been pressed into the shape F of the rail portion 4*b*, that corresponds to the wedge K1. Accordingly, the adaptor portion 9 is positioned both in respect of depth and also height relative to the rail portion 4*b* by the wedge K1, the shape F of the rail portion 4*b*, that corresponds to the wedge K1, the grub screws 29 and the self-tapping screws 30. Positioning in the longitudinal direction L of the rail portion 4*b* can be effected by the projecting bar 36 of the adaptor portion 9 (see FIG. 7).

Figure 9:
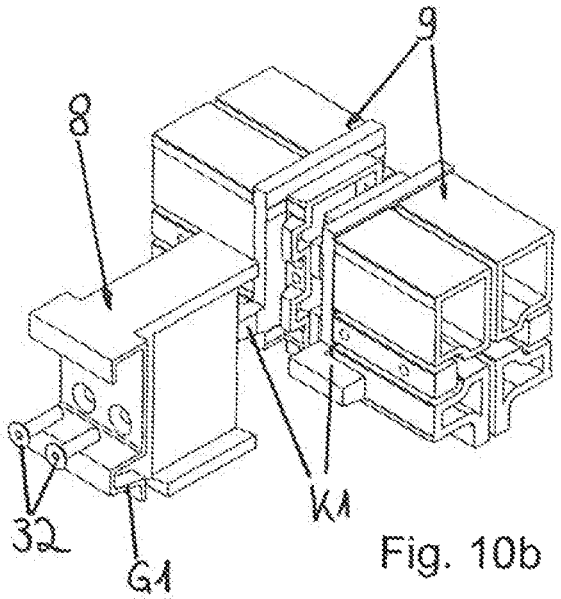
FIG. 9 shows a perspective view of two adaptor portions and the connecting portion.

FIG. 9 shows a perspective view of two adaptor portions 9 and the connecting portion 8. The connecting portion 8, like the rail portion 4*b*, has a counterpart shape G1 corresponding to the wedge K1.

Figure 10A:
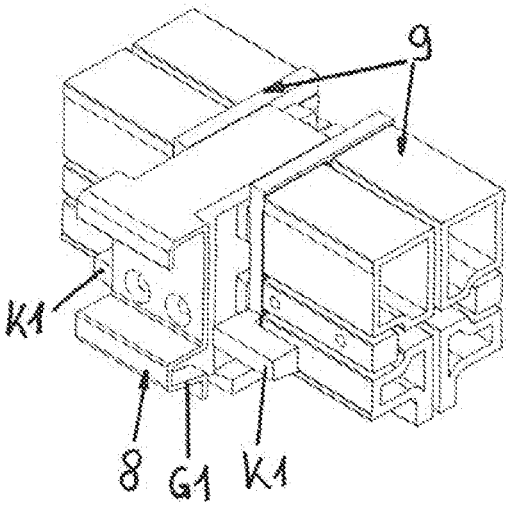
FIGS. 10*a*-10*b* show a perspective view and a sectional view thereof showing two adaptor portions and the connecting portion partially connected to the adaptor portions.
Figure 10B:
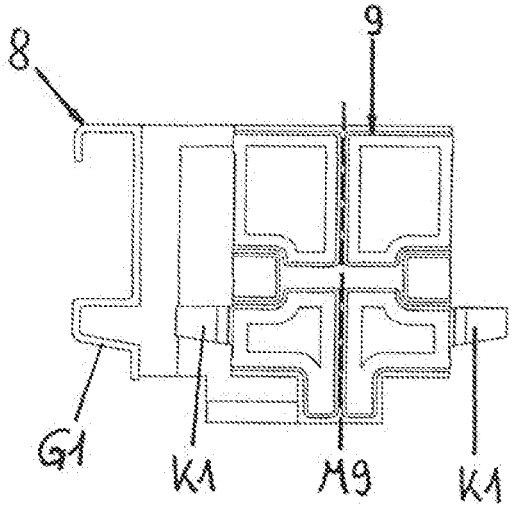

FIG. 10*a* shows a development of FIG. 9, wherein the connecting portion 8 has been partially inserted between the adaptor portions 9. FIG. 10*b* shows a sectional view of FIG. 10*a*. In this case the central plane M9 of the adaptor portion 9 is visible. It is therefore provided that the respective at least one adaptor portion 9 is of a mirror-image symmetrical configuration relative to the central plane M9. The wedge K1 shown at the right is not necessary in this view for making the connection, but the adaptor portions 9 can be used universally for both ends of a rail portion 4*a*, 4*b*.

Figure 11A:
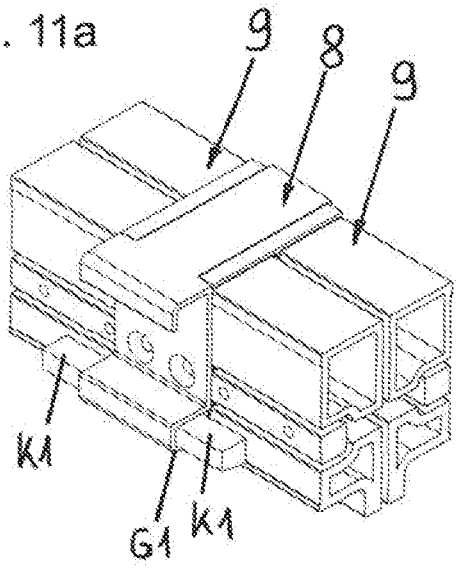
FIGS. 11*a*-11*b* show a perspective view and a sectional view thereof showing two adaptor portions and the connecting portion connected to the adaptor portions.
Figure 11B:
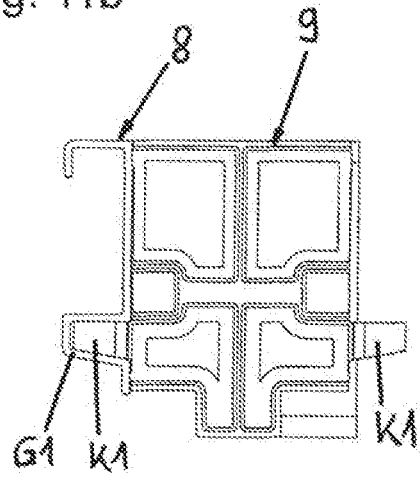

FIG. 11*a* in turn shows a development of FIG. 10*a*, wherein the connecting portion 10 has been inserted completely between the two adaptor portions 9. FIG. 11*b* shows a sectional view of FIG. 11*a*. In this view the screws 32 can then be screwed into the corresponding holes in the connecting portion 8 and the adaptor portions 9 so that the connecting portion 8 is fixedly connected to the adaptor portions 9. In that way the wedge K1 shown at the left of the adaptor portion 9 is moved into the counterpart shape G1 of the connecting portion 8 so that the connecting portion 8 is adjusted in respect of height and depth.

Figure 12A:
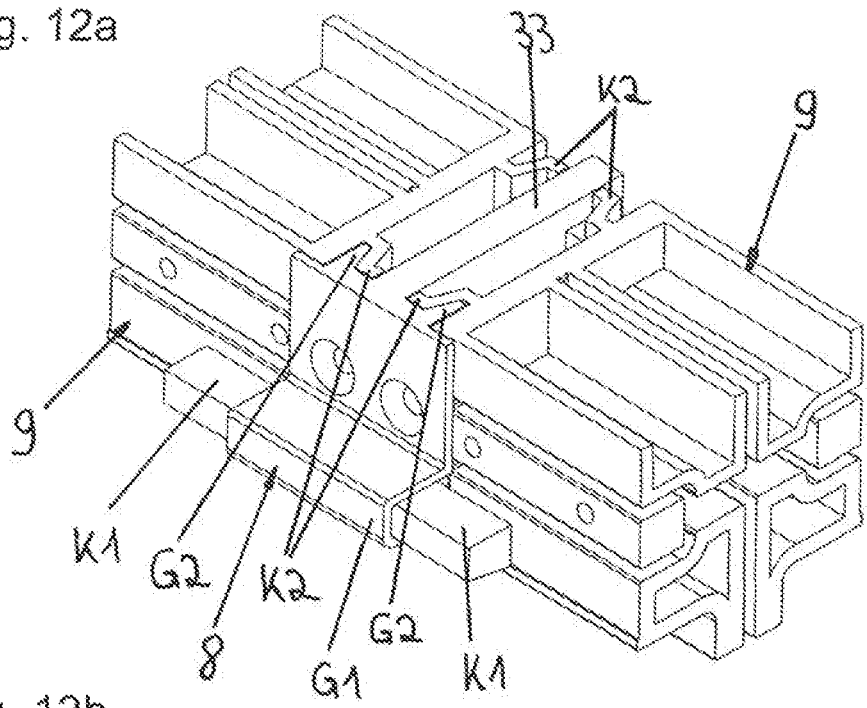
FIGS. 12*a*-12*b* show a perspective view and a plan view of a section of FIG. 11*a*.

FIG. 12*a* shows the view in FIG. 11*a*, with the upper part of FIG. 11*a* being cut away. In that respect it can be seen that the adaptor portions 9 have further wedges K1 which, when the adaptor portions 9 are connected to the connecting portion 8 cooperate with further counterpart shapes G2 of the connecting portion 8. In addition the connecting portion 8 has a central bar 33 so that the adaptor portions 9 do not bear against each other upon being connected by way of the connecting portion 8.

Figure 12B:
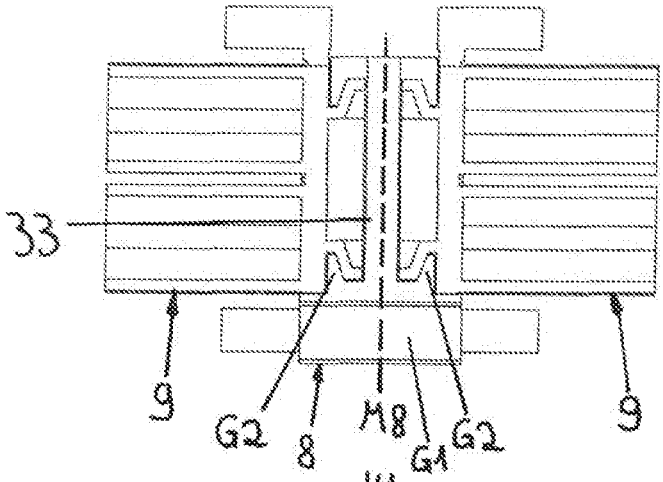

FIG. 12*b* shows a plan view of FIG. 12*a*. In this case the central plane M8 of the connecting portion 8 is also shown. It is therefore provided that the at least one connecting portion 8 is of a mirror-image symmetrical configuration relative to the central plane M8. When the screws 32 are screwed into the respective holes in the connecting portion 8 and the adaptor portions 9 the counterpart shapes G2 are pressed against the wedges K2 so that the adaptor portions 9 are moved relative to each other. It is therefore provided that the rail portions 4*a*, 4*b* of the at least one first guide rail 4 can be positioned relative to each other with the at least one connecting portion 8, by way of at least one positioning device K1, K2, G1, G2, preferably wherein the at least one respective positioning device has at least one wedge K1, K2 and at least one corresponding counterpart shape G1, G2.

Figure 13:
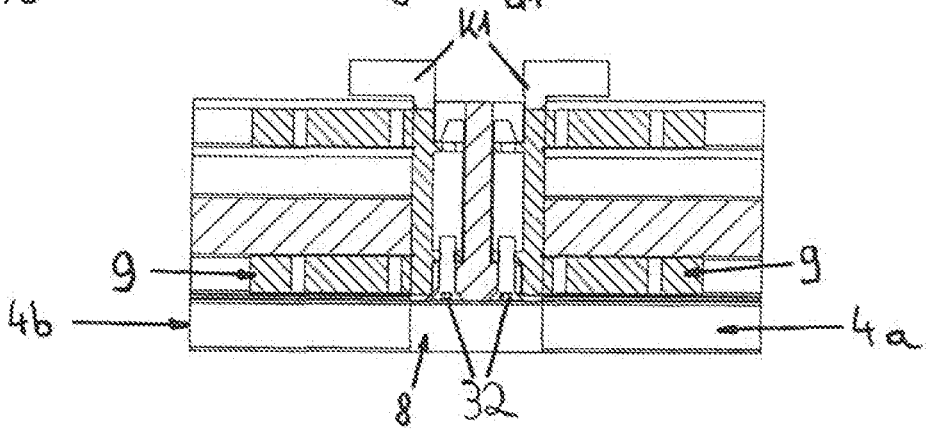
FIG. 13 shows a further sectional view of FIG. 11*a* with the rail portions.

FIG. 13 shows a sectional view of FIG. 12*b* through the plane of the screws 32, the rail portions 4*a*, 4*b* additionally being shown. In addition the screws 32 are screwed into the connecting portion 8 and the adaptor portions 9, wherein those screws 32 have a male thread cooperating with a female thread of the respective holes in the adaptor portions 9. The grub screws 29 which are screwed like the screws 32 into the lower holes in the view and the self-tapping screws 30 which are screwed into the upper holes in the view are not shown. The positioning device K1, K2, G1, G2 therefore serves on the one hand for positioning the connecting portions 8 relative to the adaptor portions 9 and the rail portions 4*a*, 4*b* respectively and on the other hand for positioning the adaptor portions 9 relative to the rail portions 4*a*, 4*b*. After the respective positioning operation has been carried out the running surfaces 7*a*, 7*b* have been completed by the portions A1, A2 of the connecting portion 8. Accordingly the carriage 5 runs only over the running surfaces 7*a*, 7*b* provided on the rail portions 4*a*, 4*b* and over the portions A1, A2 of the running surfaces 7*a*, 7*b* of the connecting portion 8. In other words, when the carriage 5 runs along the first guide rail 4, the individual rolling bodies 6*a*, 6*b* do not come directly into contact with the adaptor portions 9.

Figure 14A:
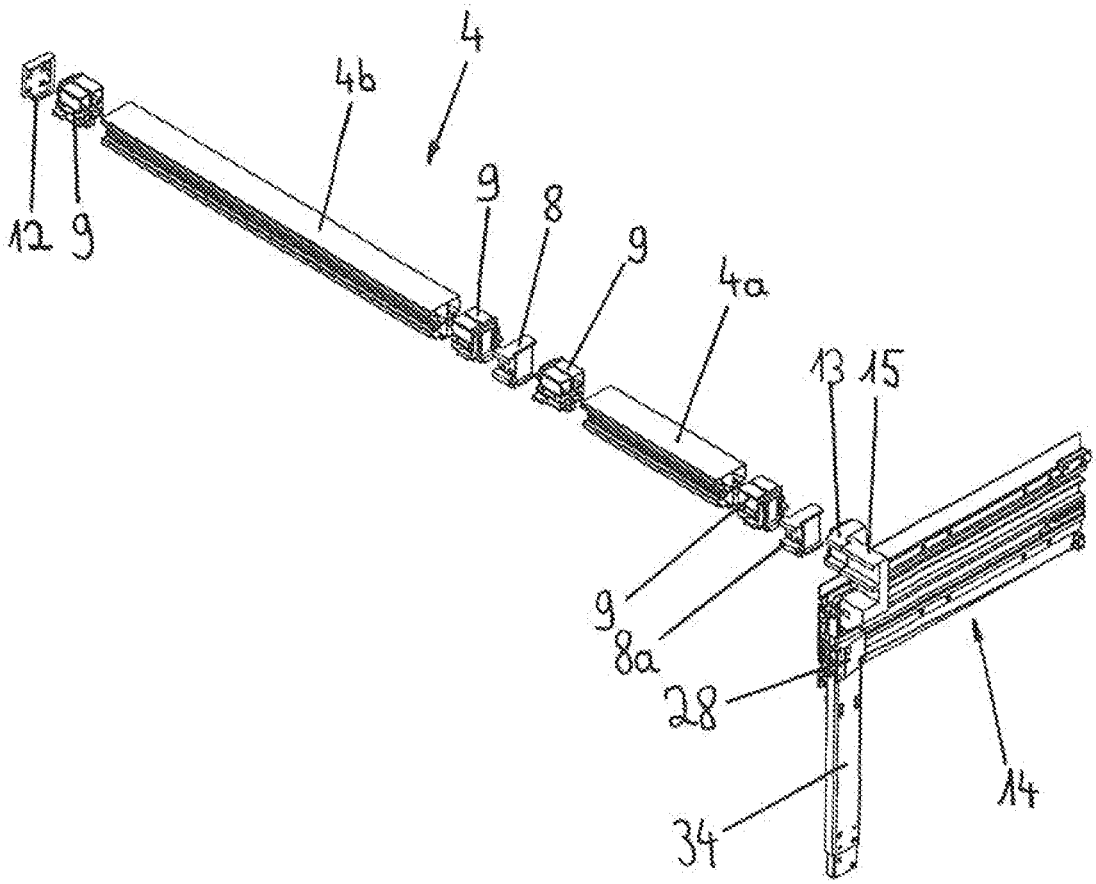
FIGS. 14*a*-14*b* show perspective views of a further embodiment of a first guide rail which has been cut into pieces.
Figure 14B:
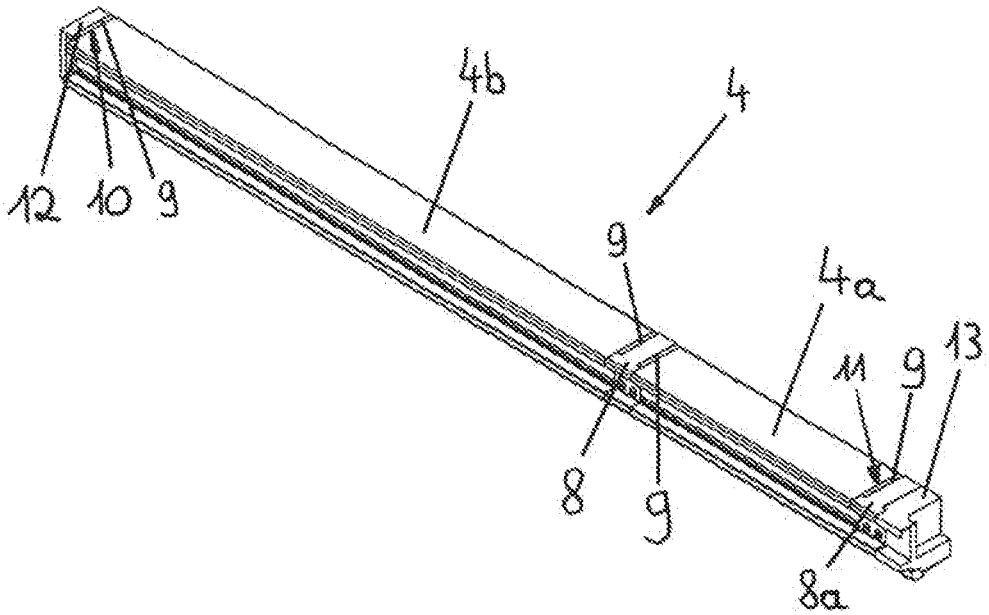

FIGS. 14*a* and 14*b* show a further embodiment of the first guide rail 4. In this case it is possible to see the further guide rail 14 which is arranged substantially transversely relative to the first guide rail 4. The vertical carrier structure 34 and the carrier 15 arranged thereon are mounted displaceably on that further guide rail 14. In addition a hinge 28 is arranged at the carrier structure 34, serving for fixing the first door leaf 2*a*. In this arrangement disposed at the two ends 10, 11 of the first guide rail 4 are the two termination portions 12, 13, the termination portion 13 additionally performing the function of the transfer device 23 shown in FIG. 2. That termination portion 13 is connected by way of the further connecting portion 8*a* to the first rail portion 4*a* of the first guide rail 4.

It can therefore be provided that the at least one first guide rail 4 has a termination portion 12, 13 at one or at both ends 10, 11. It can further be provided that at least one of the termination portions 13 can be releasably connected to the at least one first guide rail 4, preferably by way of at least one further connecting portion 8*a* which is identical to the at least one connecting portion 8, by way of which the two rail portions 4*a*, 4*b* of the at least one first guide rail 4 can be releasably connected.

In the case of a guide system 1 it can also be provided that all component parts from which the guide system 1 is made up are of a maximum length of 1200 mm and a maximum width of 800 mm so that they can be arranged on an Europool pallet for dispatch purposes.

LIST OF REFERENCES

1 guide system
2 furniture door
2*a* first door leaf
2*b* second door leaf
3 stationary furniture part
4 first guide rail
4*a* first rail portion
4*b* second rail portion
5 running carriage
6*a*, 6*b* rolling body
7*a*, 7*b* running surface
8 connecting portion
8*a* further connecting portion
9 adaptor portion
10, 11 ends of the first guide rail
12, 13 termination portion
14 further guide rail
15 carrier
16 article of furniture
17 folding door hinge
18 receiving region
19 component parts of a kitchen
20 clothes storage arrangement
21 receiving pocket
22 bar
23 transfer device
24 fitment
25 carrier profile member
26 control roller
27 furniture wall
28 hinges
29 grub screws
30 self-tapping screws
31 surface
32 screws
33 central bar
34 vertical carrier structure
35 elongate slot
36 projecting bar
A1 portion of the running surface 7*a*
A2 portion of the running surface 7*b*
L longitudinal direction
K1 wedge
K2 wedge
G1 counterpart shape
G2 counterpart shape
M8 central plane
MK9 central plane
V vertical axis
F shape of the rail portions corresponding to the wedge K1

The invention claimed is:

1. A guide system for guiding a furniture door relative to a stationary furniture part, comprising:

a first guide rail; and a running carriage which can be connected to the furniture door, the running carriage having a rolling body by way of which the running carriage is mounted moveably on the first guide rail, wherein the first guide rail is composed in a longitudinal direction of a first rail portion and a second rail portion, the first and second rail portions being releasably connected by way of a connecting portion, wherein each of the first rail portion, the second rail portion and the connecting portion has a respective running surface portion, and the first and second rail portions and the connecting portion are arranged such that the respective running surface portions form a continuous running surface for the rolling body of the running carriage, wherein the first and second rail portions of the first guide rail are each in the form of a hollow chamber profile member having a protrusion extending from an outer surface of the hollow chamber profile member, the hollow chamber profile member having one or more hollow chambers formed therein, wherein the running surface portion of the first rail portion is arranged on the protrusion of the first rail portion, and the running surface portion of the second rail portion is arranged on the protrusion of the second rail portion, and wherein at least one of the first and second rail portions is adaptable in respect of its length while remaining connectable to further rail portions.

2. The guide system according to claim 1, wherein the furniture door is a folding door or a folding-sliding door.

3. The guide system according to claim 1, wherein respective end regions of the first and second rail portions are each configured to receive a respective adaptor portion.

4. The guide system according to claim 1, wherein the first and second rail portions of the first guide rail are positioned relative to the connecting portion by way of a positioning device.

5. The guide system according to claim 4, wherein the positioning device includes first and second wedges provided on the first and second rail portions, respectively, and first and second counterpart shapes configured to receive the first and second wedges, respectively, the first and second counterpart shapes being provided on the connecting portion.

6. The guide system according to claim 1, wherein the connecting portion has a mirror-image symmetrical configuration relative to a central plane.

7. The guide system according to claim 1, wherein the first and second rail portions of the first guide rail each have a respective adaptor portion, the first and second rail portions being releasably connected to the connecting portion by way of the adaptor portions.

8. The guide system according to claim 7, wherein the first and second rail portions are releasably connected to the connecting portion by way of the adaptor portions with a screw and/or clamping connection.

9. The guide system according to claim 7, wherein each adaptor portion has a mirror-image symmetrical configuration relative to a central plane.

10. The guide system according to claim 7, wherein each of the first and second rail portions is releasably connected to its respective adaptor portion.

11. The guide system according to claim 10, wherein each of the first and second rail portions is releasably connected to its respective adaptor portion by way of a screw and/or clamping connection.

12. The guide system according to claim 10, wherein the adaptor portions are releasably connected to the first and second rail portions, respectively, so as to be moveable in a direction toward the running surface.

13. The guide system according to claim 7, wherein each adaptor portion is substantially concealed outwardly by its respective one of the first and second rail portions and by the connecting portion.

14. The guide system according to claim 1, wherein all component parts from which the guide system can be composed are of a maximum length of 1200 mm and a maximum width of 800 mm so that they can be arranged for dispatch purposes on an Europool pallet.

15. The guide system according to claim 1, wherein the first guide rail has a termination portion at one end or at both ends.

16. The guide system according to claim 15, wherein the termination portion of at least one of the ends of the first guide rail is releasably connected to the first guide rail, by way of which the first and second rail portions of the first guide rail are releasably connected.

17. The guide system according to claim 16, wherein the connecting portion is a first connecting portion, and wherein the termination portion of the at least one of the ends of the first guide rail is releasably connected to the first guide rail by way of a second connecting portion, the second connecting portion being identical to the first connecting portion.

18. The guide system according to claim 1, further comprising a second guide rail and a carrier, wherein the carrier is mounted moveably to the second guide rail, and wherein the running carriage can be arranged on or at the carrier, and the carrier can be arranged on the second guide rail at a position relative to the first guide rail such that the carrier acts as an extension of the first guide rail.

19. An article of furniture comprising:

a furniture door;

a stationary furniture part; and the guide system according to claim 16 for guiding the furniture door relative to the stationary furniture part.

20. The article of furniture according to claim 19, wherein the furniture door is a folding door or a folding-sliding door.

* * * * *